US006886592B1

(12) United States Patent
Hart, Jr.

(10) Patent No.: US 6,886,592 B1
(45) Date of Patent: May 3, 2005

(54) SEWER RELIEF VALVE WITH INTEGRAL DISINFECTANT MEANS

(76) Inventor: James R. Hart, Jr., 1261 Gondola Ct., Boynton Beach, FL (US) 33426

( * ) Notice: Subject to any disclaimer, the term of this patent is extended or adjusted under 35 U.S.C. 154(b) by 0 days.

(21) Appl. No.: 10/779,407

(22) Filed: Feb. 12, 2004

(51) Int. Cl.[7] ..... F16K 37/00; F16K 31/22
(52) U.S. Cl. ..... 137/554; 137/533.31; 137/268; 4/211; 4/220; 4/669
(58) Field of Search ..... 137/533.31, 533, 137/554, 558, 268; 4/211, 220, 669, 689, 4/219

(56) References Cited

U.S. PATENT DOCUMENTS

| | | | | |
|---|---|---|---|---|
| 561,381 | A * | 6/1896 | Ellis | 4/220 |
| 999,053 | A * | 7/1911 | Mitchell | 4/220 |
| 1,230,473 | A * | 6/1917 | Freeman, Jr. | 4/220 |
| 1,383,938 | A * | 7/1921 | Hageman | 4/220 |
| 3,771,968 | A * | 11/1973 | Stalnaker | 137/268 |
| 4,392,128 | A * | 7/1983 | Young et al. | 137/558 |
| 4,805,665 | A * | 2/1989 | League | 137/554 |
| 4,850,059 | A * | 7/1989 | Dickerson | 4/211 |
| 4,917,147 | A * | 4/1990 | Jerkins | 137/584 |
| 5,113,901 | A * | 5/1992 | Young | 137/554 |
| 5,209,257 | A * | 5/1993 | Baker, Jr. | 137/533.31 |
| 6,358,408 | B1 * | 3/2002 | Newman | 137/551 |

* cited by examiner

*Primary Examiner*—Kevin Lee
(74) *Attorney, Agent, or Firm*—McHale & Slavin, P.A.

(57) ABSTRACT

A sewer relief valve assembly comprises a cylindrical sleeve dimensioned for insertion into a clean out which has an interior surface formed as a conduit and exterior threads adapted for mated engagement with the interior threads of the clean out. A valve means is disposed in the cylindrical sleeve which is displaceable from a closed position to an open position by pressurized fluid in the clean out. At least one perforated compartment is disposed inside the cylindrical sleeve which contains a water-soluble disinfectant composition. The valve means is displaceable by fluid pressure to the open position permitting discharge of the effluent through the clean out and the simultaneous release of the water-soluble disinfectant composition from the perforated compartment into the effluent. A water-soluble dye composition can also be included in the perforated compartment so that sewage overflow from the clean out is readily visible.

17 Claims, 5 Drawing Sheets

SEWER RELIEF VALVE WITH INTEGRAL DISINFECTANT MEANS

FIELD OF THE INVENTION

This invention is related to a cap for a sewer clean out which functions as a release valve, and particularly to such a valve which includes an integral disinfectant means for sewer effluent.

BACKGROUND OF THE INVENTION

In a conventional residential sewer collection system, discharge from various receptacles present in the interior plumbing arrangement drains into a vertical collection line and then into a sewage collection line. Households are usually connected to the sewer line by clay, cast-iron, or polyvinyl chloride (PVC) pipes 3 to 4 inches in diameter. The sewage collection line conducts sewage collected from various receptacles present in the interior plumbing into a sewer main or septic tank. Unlike water-supply systems, wastewater flows through sewer pipes by gravity rather than by pressure. Due to the lack of pressure, blockages can occur in the sewer collection line, which can have the very unpleasant result of sewer water backing up in sinks, toilets, and bathtubs. This is a particular problem for multi-story buildings, since the sewer lines on the lower floor can become clogged while higher stories continue to empty water into the sewer line, which can cause the lower floors to be flooded with sewer water.

Building codes require sewer systems to have clean outs which provide access to clear blockages in the sewage collection line as may occur over time with the line becoming partially blocked by tree roots or other foreign objects. The clean out allows the blockage to be reached using tools such as plumbing snakes. The clean out is usually a vertical conduit extending from the sewage line to a point at or near ground level. The upper end of the clean out has internal threads so that a cap or fitting with mated threads can be screwed therein.

It is well known in the art to replace the clean out cap with an escape valve so that sewage back up will overflow through the clean out, instead of overflowing into toilets, sinks etc. Some prior art patents are directed to blow-out type caps ejectable by pressure present in the pipes, such as U.S. Pat. Nos. 4,261,386, 3,895,466, and 4,850,059. Valve type sewer backflow preventors include U.S. Pat. No. 5,645,099, 4,917,147, 4,215,724.

Baker, Jr., U.S. Pat. No. 5,209,257, discloses a vent for relieving pressure in a sewer system which comprises a threaded plug having a buoyant float closure seated therein. The elongated configuration causes the float to reseat itself.

Westerhoff, U.S. Pat. No. 3,805,826, discloses a relief valve which is substituted for the normal plug which comprises two concentric cylindrical portions slidable with respect to one another. The upper portion is sealed at the top, and includes side vents for discharge. A screw keeps the upper portion from being ejected by pressure.

Several prior art patents disclose an arrangement wherein an audible buzzer is activated in the event of an overflow. For example, Young et al., U.S. Pat. No. 4,392,128, Allen, U.S. Pat. No. 4,091,365, and Statz, U.S. Pat. No. 4,398,186 each discloses a device where an electric circuit is closed by the mechanical action caused by the rising water to set off a warning alarm.

The prior art systems are effective to provide a means by which backflow into interior plumbing fixtures is prevented.

While it is certainly preferable that the sewage backflow overflow in an outdoor environment rather than inside, the presence of the effluent on the ground can create a health hazard. Children and pets in particular can easily come into contact with the unsanitary ground area.

Thus, what is needed is a means to chemically treat sewage water overflowing from a clean out in order to reduce or eliminate harmful bacteria present in the sewage overflow, as well as to neutralize foul odors. The present invention overcomes the drawbacks of the prior art devices by providing a sewer clean out cap which functions as an overflow valve, and which also includes an integral means of disinfecting sewer effluent as it flows through the device so that the immediate environment is not contaminated.

SUMMARY OF THE INVENTION

It is an objective of the invention to provide a sewer relief valve assembly for a sewer clean out which prevents interior sewer flooding by providing an exterior valve outlet to release pressurized fluids.

It is a further objective of the invention to provide a sewer relief valve assembly which includes an integral disinfectant means in the form of a water-soluble composition to treat overflow fluids discharged through the clean out.

It is another objective to provide a sewer relief valve assembly for a sewer clean out which includes a water-soluble dye composition disposed therein so that effluent from the clean out is dyed a highly visible color.

It is still another objective to provide a sewer relief valve assembly for a sewer clean out which includes an alarm means to indicate that an overflow has occurred.

It is a further objective of the invention to provide a sewer relief valve assembly which includes a light-emitting diode (LED) which is illuminated for a specified period after an overflow has occurred.

It is yet a further objective of the invention to provide a sewer relief valve assembly which includes a refillable perforated compartment formed integrally therewith for receiving water-soluble dye and disinfectant compositions.

In accordance with the above objectives, a sewer relief valve assembly for a sewer clean out having interior threads comprises a cylindrical sleeve dimensioned for insertion into the clean out which has an interior surface formed as a conduit and exterior threads adapted for mated engagement with the interior threads of the clean out. A valve means is disposed in the cylindrical sleeve which is displaceable from a closed position to an open position by pressurized fluid in the clean out. At least one perforated compartment is disposed inside the cylindrical sleeve which contains a water-soluble disinfectant composition. The valve means is displaceable by fluid pressure to the open position permitting discharge of the effluent through the clean out and the simultaneous release of the water-soluble disinfectant composition from the perforated compartment into the effluent. A water-soluble dye composition can also be included in the perforated compartment so that sewage overflow from the clean out is readily visible. The perforated compartment can comprise a plurality of walls defining an interior space, with one of the walls including a hingedly moveable door member having a latch means attached thereto whereby the interior space can be accessed to replenish the water-soluble disinfectant and/or dye composition.

In a preferred embodiment, the cylindrical sleeve can include at least two longitudinal slots therein having a length and an upper portion terminating in a flange. The valve means can comprise a float member vertically displaceable in the cylindrical sleeve which has an upper portion having a configuration complementary to the flange. The upper portion is seated in the flange in the closed position and includes a top surface which forms a cover for the clean out in the closed position. The float member further comprises an elongate lower portion descending into the cylindrical sleeve which preferably has a frusto-conical configuration. The lower portion includes at least two arms extending laterally therefrom corresponding to the at least two slots which are slidably positioned in the slots such that the float member is fixedly attached to the cylindrical sleeve and upwardly vertically displaceable along the length of the longitudinal slots to the open position.

The device can further include a sensing means for detecting when the valve means is in an open position and an alarm means coupled to the sensing means which is activated when the valve is in the open position. A timing means can be coupled to the alarm means so that the alarm means is activated continuously for a predetermined period after the valve is opened. The alarm means can be a light-emitting diode (LED) which is illuminated in response to the opening of the valve.

In a preferred embodiment, the components of the alarm mechanism are disposed inside the float member. The upper portion and lower portion of the float member are detachable from one another to provide access to the alarm mechanism, and preferably respectively include mated threads. The alarm mechanism can comprise a first magnetic strip adjoined to the cylindrical sleeve and a second magnetic member strip adjoined to the float member such that the first magnetic strip and the second magnetic strip are in contact with one another when the float member is in the closed position. An electric circuit is disposed within the float member in electrical communication with a power source such as a battery. An alarm means in electrical communication with the circuit, and a switch means is in communication with the second magnetic strip and the electric circuit, with the switch being operable to energize the electric circuit when contact between the first and second magnetic strips is terminated, wherein the alarm means is activated when the contact is broken. A timing means can be coupled to the alarm means, wherein the alarm means is activated continuously for a predetermined period.

DETAILED DESCRIPTION OF THE INVENTION

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

Figure 1:
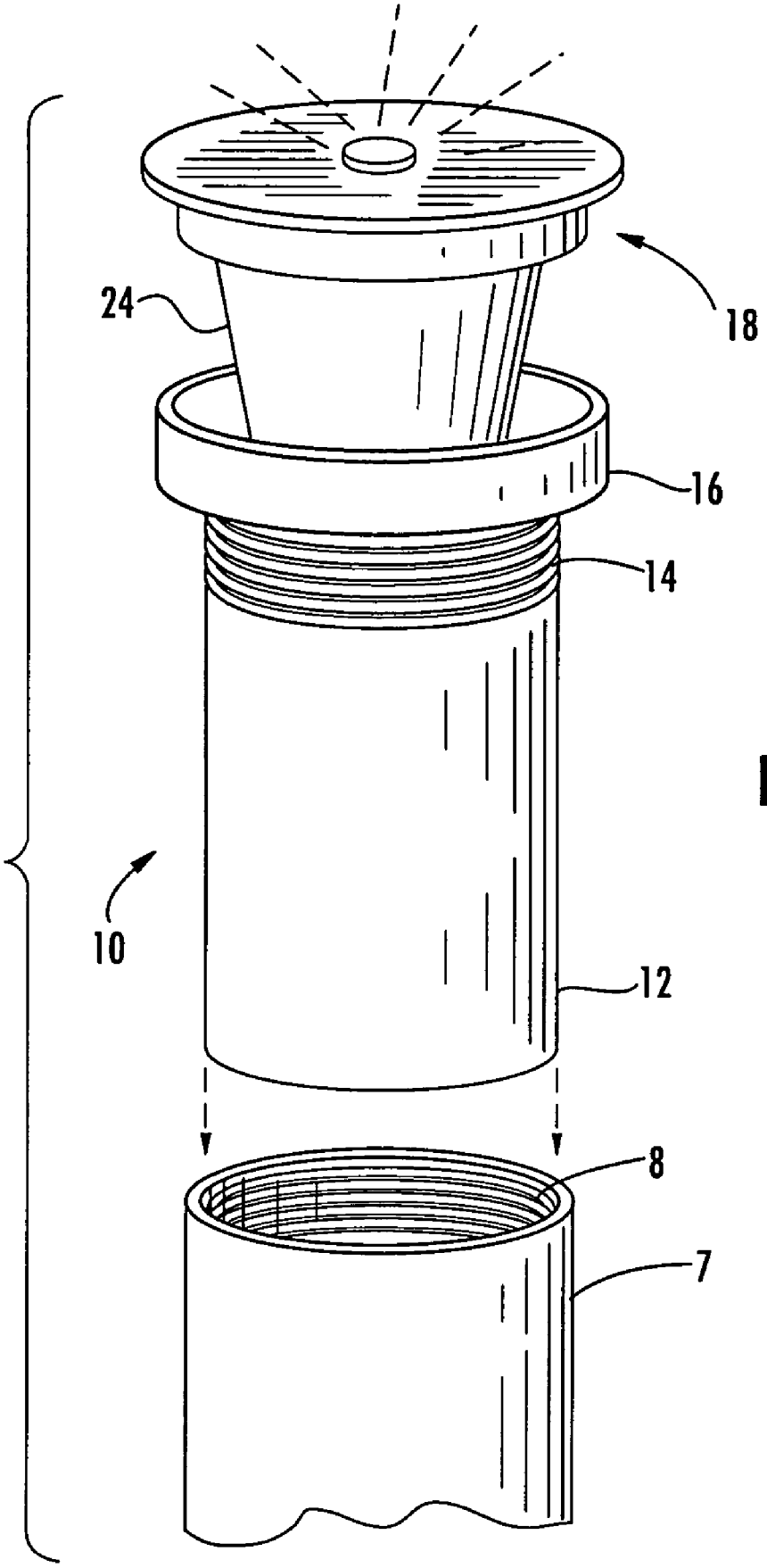
FIG. 1 is an exploded view of a preferred embodiment of the invention in which the sewer relief valve assembly is shown disassembled from a clean out pipe.

FIG. 1 is an exploded view of the instant invention in which the sewer relief valve assembly 10 according to a preferred embodiment of the invention is shown disassembled from clean out pipe 7. The clean out pipe 7, typically four inch PVC pipe, is vertically oriented and extends from the sewer pipe line to a point just above the ground. The clean out pipe 7 is generally provided with a removable threaded plug which engages with the interior threads 8 of the clean out pipe 7. In FIG. 1, the threaded plug has been removed to permit installation of the device 10 into the clean out pipe 7.

The device 10 includes a cylindrical sleeve 12 dimensioned to fit coaxially within the clean out 7. The cylindrical sleeve 12 has an upper end terminating in a flange 16, and includes threads 14 adjacent the flange 16 which securely threadingly engage with threads 8 of the clean out 7. In a preferred embodiment, the cylindrical sleeve is formed from polyvinyl chloride (PVC).

Figure 2:
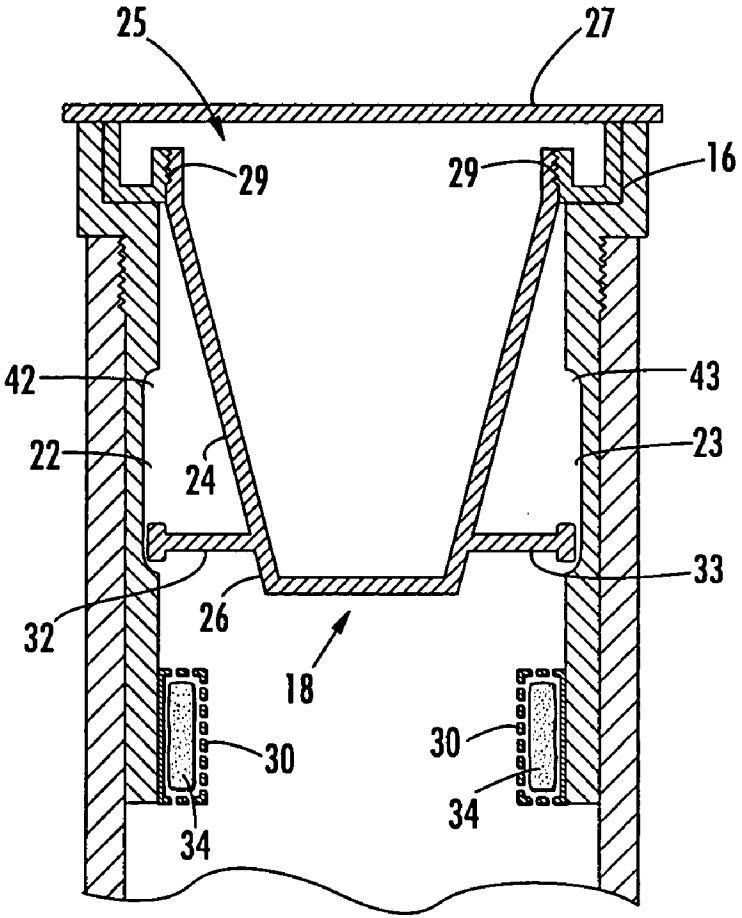
FIG. 2 is a cross section view of the sewer relief valve assembly installed in a clean out with the valve means in a closed position.

A valve means 18 is slidingly disposed in the cylindrical sleeve 12 which is displaceable from a closed position to an open position by pressurized fluid in the clean out. The operative elements of the valve means 18 can be seen in the cross-sectional views shown in FIGS. 2 and 3. In the embodiment shown in FIGS. 2 and 3, the cylindrical sleeve 12 fits in close alignment with the clean out 7. The cylindrical sleeve includes at least two longitudinal slots 22 and 23 (seen in detail in FIG. 5), which can be formed either as channels or apertures. The valve means 18 can include float member 24 which is vertically displaceable within the cylindrical sleeve 12. The float member 24 has an upper portion 25 which has a configuration which is complementary to the flange 16 so that the upper portion 25 is seated in the flange 16 when the valve means is in closed position, as shown in FIG. 2. The upper portion 25 has a top surface 27 which forms a cover for the clean out 7. The float member 24 includes an elongate lower portion 28 descending into said cylindrical sleeve 12 which preferably has a frusto-conical configuration. As can be best seen in FIG. 4, the lower portion includes at least two arms 32, 33 extending laterally therefrom. The at least two arms are positioned to correspond with the slots 22, 23 such that the arms 32, 33 are slidably positioned in said slots 22,23. The float member 24 is thus fixedly attached to the cylindrical sleeve 12, and is upwardly displaceable along the length of the longitudinal slots to an open position. Pressurized fluid in the clean out pushes the float member 24 upward until the arms 32, 33 encounter the top edges 42, 43 of the slots 22,23. Fluids can then flow out of the cylindrical sleeve 12. When the pressure subsides, the float member 24 automatically falls to be reseated in the flange 16, and in this way reciprocates back to the closed position. The components of the float member 24 of the present invention can be manufactured using polyvinyl chloride (PVC), or any other suitable material.

Figure 8:
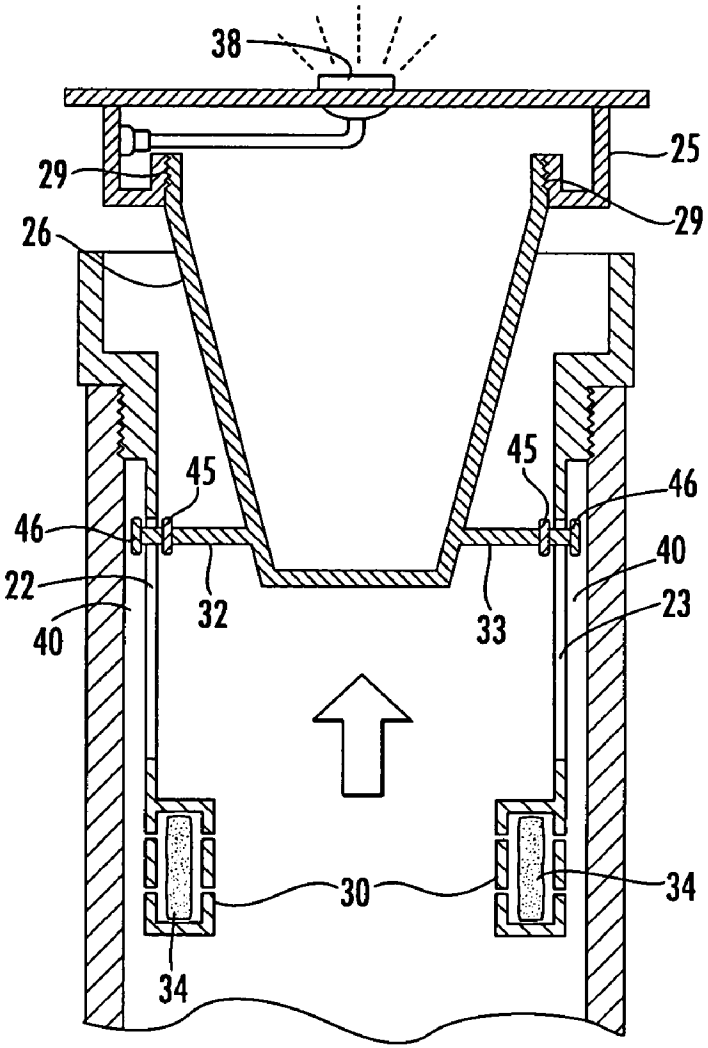
FIG. 8 illustrates the device shown in FIG. 7, in which the valve means is in a open position and the LED is illuminated in response.
Figure 7:
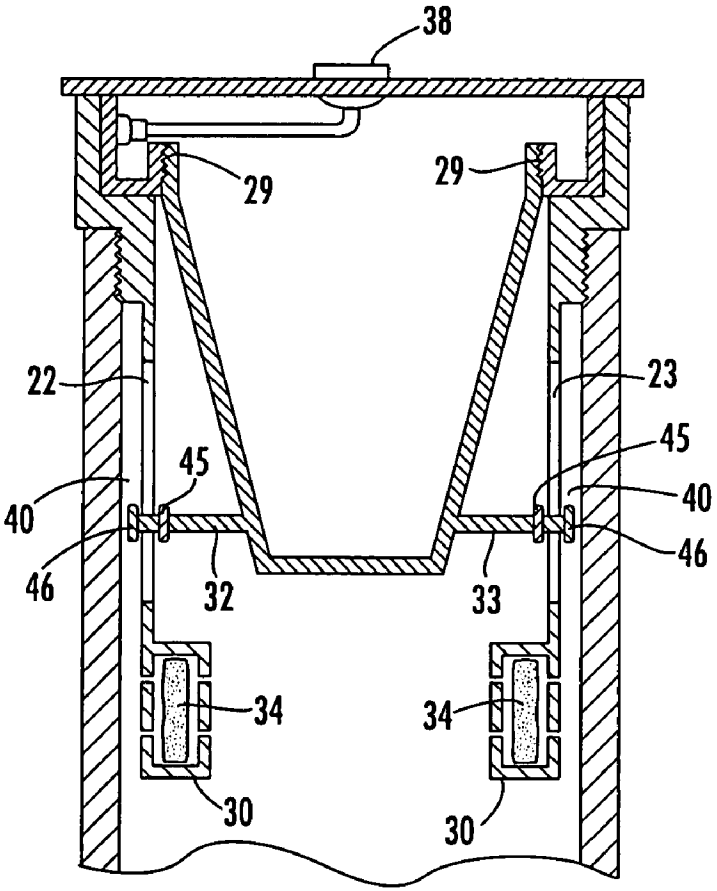
FIG. 7 illustrates an alternative arrangement for attachment of the float member to the cylindrical sleeve, in which the valve means is in a closed position.

An alternative embodiment for the cylindrical sleeve is shown is shown in FIGS. 7 and 8. In this embodiment, the diameter of the cylindrical sleeve 12 is dimensioned to provide a space 40 between the clean out 7 and the sleeve 12. The distal ends of the arms 32, 33 extend into the slots 22, 23 and respectively include a first end member 45 positioned inside the sleeve 12 and a second end member 46 positioned in said space 40 whereby the arms 32, 33 are slidably disposed inside the slots 22,23.

Figure 3:
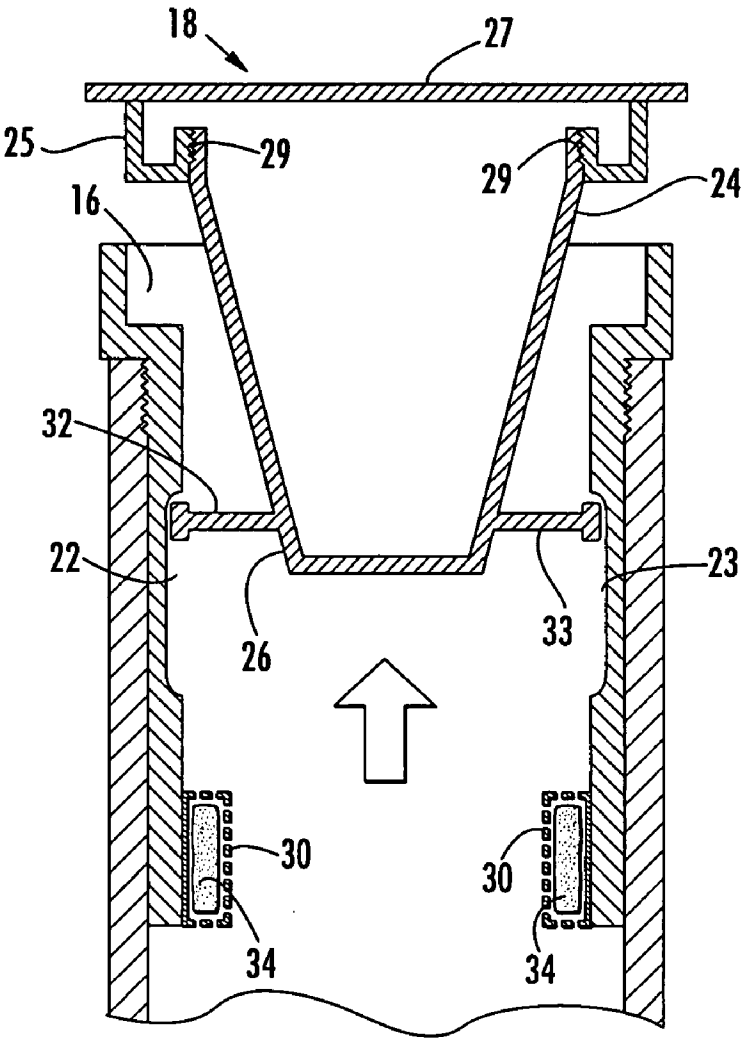
FIG. 3 is a cross section view of the sewer relief valve assembly installed in a clean out with the valve means in a closed position.
Figure 4:
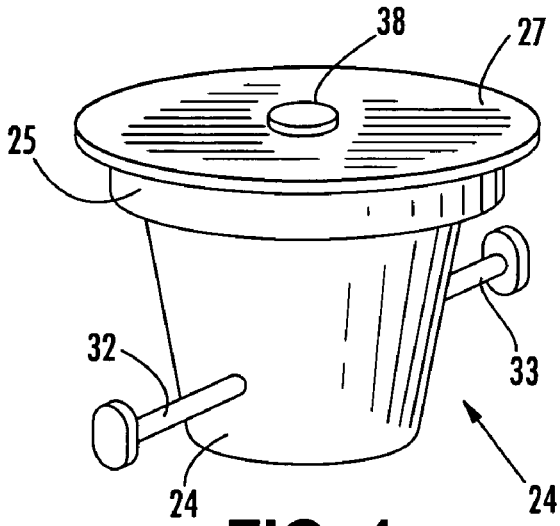
FIG. 4 is perspective view of the float member, shown disassembled from the device.

The cylindrical sleeve 12 includes therein at least one perforated compartment 30 positioned to be in the path of the liquid flow. The perforated compartment 30 contains a water-soluble disinfectant composition, indicated in FIGS. 2 and 3 as 34. The water-soluble disinfectant composition 34 can be in tablet form (as shown in FIGS. 2 and 3) or alternatively can be in the form of a powdered substance.

Any suitable disinfectant agent can be used in the practice of the present invention. The disinfectant composition 34 preferably includes antimicrobial compositions manufactured into a solid form. The antibacterial compounds are preferably U.S. Environmental Protection Agency approved for use as sanitizers or disinfectants. Appropriate antimicrobial agents include, but are not limited to, quaternary ammonium compounds, fatty amines and diamines, chlorhexidine gluconate, phenol and halogen or methyl substituted phenols, parachlorometa xylenol methyl substituted phenols, parachlorometa xylenol, and mixtures thereof.

As liquids flow through the cylindrical sleeve 12, the liquid enters the perforated compartment 30 and flows therethrough. The disinfectant composition 34 then permeates the effluent prior to expulsion to the environment.

Figure 5:
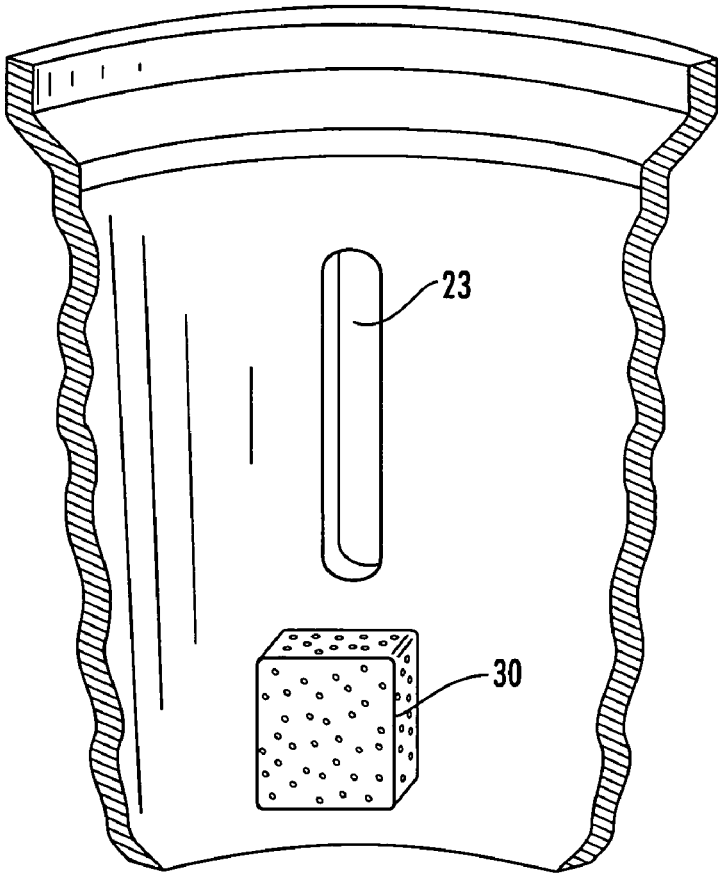
FIG. 5 is a cutaway view of the cylindrical sleeve showing the longitudinal slot and the perforated compartment therein.

In the illustrated embodiment shown in FIG. 5, the perforated compartment 30 is a rectangular prism, however, in the practice of the invention, the compartment 30 can have any desired configuration. For example, the compartment 30 can be formed as an annular ring within the cylindrical sleeve 12 to maximize the volume of fluid encountering the disinfectant composition 34. Any number of perforated compartments 30 can be included in the cylindrical sleeve 12. The perforated compartment 30 is constructed to include a plurality of walls defining an interior space. One of the walls preferably includes a hingedly moveable door member (not shown) which has a latch means allowing the interior space to be accessed to periodically replenish the water-soluble disinfectant composition 34. If the water-soluble disinfectant composition 34 is in tablet form, the tablets can be manufactured to have a complementary fit to that of the interior space for ease of replacement.

In addition to the water-soluble disinfectant composition 34, the perforated compartment 30 can also include a water-soluble dye composition, which can be impregnated into the water-soluble disinfectant composition 34 or provided separately. The water-soluble dye composition dyes the effluent as it flows out of the clean out 7 so that it will be immediately evident to an observer that an overflow has taken place. The dye color is selected for the maximum degree of visibility in the environment. For example, the dye color can be a bright color (such as red or blue) or can be a phosphorescent color.

The device 10 may include an alarm mechanism which indicates an overflow through the clean out. The device 10 can have a sensing means for detecting when said valve means is in an open position which is coupled to an alarm means. The alarm means is activated when the valve is in the open position. A timing means is preferably coupled to the alarm means so that the alarm is activated continuously for a predetermined period. For example, the device 10 can include a light-emitting diode (LED) 38 positioned in the top surface 27 of the upper portion 25 of the float member 24 as shown in FIG. 1. When the valve means 18 is opened by pressurized fluids, the LED 38 is illuminated for a predetermined period (e.g., 24 hours).

Figure 6:
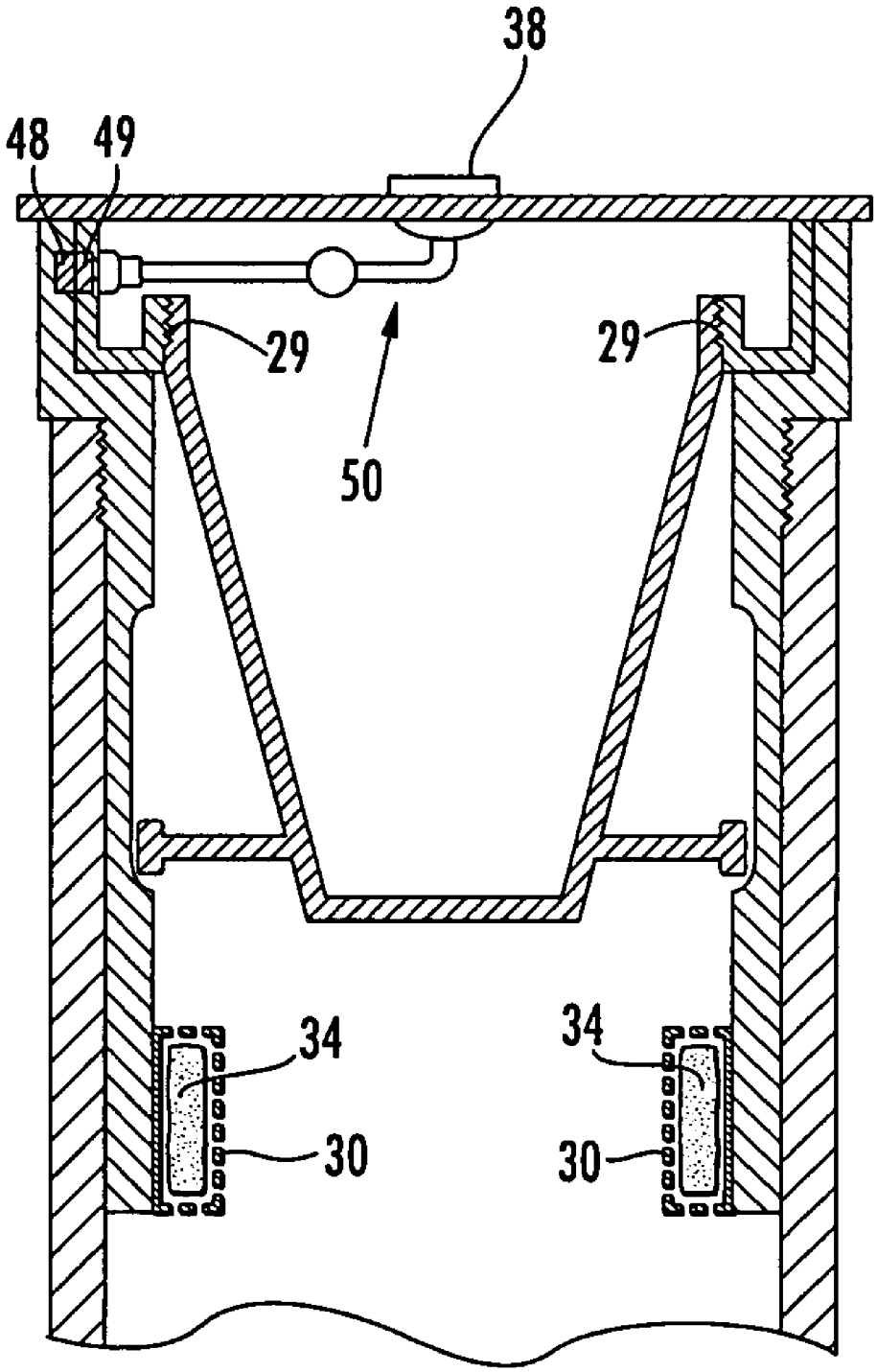
FIG. 6 illustrates a preferred configuration for an alarm means in the float member.

To provide access to the alarm means, the upper portion 25 and the lower portion 26 of the float member are preferably detachable from one another and configured to provide an interior compartment therein to house the alarm means as can be seen in FIG. 6. The upper and lower portions 25, 26 are formed as generally hollow shells which can be detached from one another by means of mated threads 29. A preferred means of implementing the alarm means is shown in FIG. 6. A first magnetic strip 48 is adjoined to the cylindrical sleeve 12, and a second magnetic strip 49 is adjoined to said float member 24 so that the first magnetic strip 48 and second magnetic strip 49 are in contact with one another when the float member 24 is in the closed position. An electric circuit generally indicated as 50 is disposed in the upper portion 25 of the float member 24 which is in electrical communication with the alarm means. The circuit 50 includes a power source, such as a battery (not shown). A switch means (not shown) is in communication with the second magnetic strip 49 and the electric circuit 50. The switch means is operable to energize the electric circuit when contact between the first and second magnetic strips is terminated to activate the alarm means. A timing means is coupled to said switch means to continuously activate the alarm means for a predetermined period. The foregoing illustrates an example of an alarm configuration, however the invention is not limited in this regard. Any suitable electronic configuration can be used. The illustrated embodiment incorporates a lighted indicator as the alarm means, however an audible alarm can also be used. An RF transmission means can also be used to activate an alarm in a remote setting, such as inside the residence.

All patents and publications mentioned in this specification are indicative of the levels of those skilled in the art to which the invention pertains. All patents and publications are herein incorporated by reference to the same extent as if each individual publication was specifically and individually indicated to be incorporated by reference. It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification. One skilled in the art will readily appreciate that the present invention is well adapted to carry out the objectives and obtain the ends and advantages mentioned, as well as those inherent therein. The various embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A sewer relief valve assembly for a sewer clean out having interior threads, comprising:

a cylindrical sleeve dimensioned for insertion into the clean out and having an interior surface formed as a conduit and exterior threads adapted for mated engagement with the interior threads of the clean out, valve means disposed in said cylindrical sleeve displaceable from a closed position to an open position by pressurized fluid in the clean out, at least one perforated compartment adjoined to said interior surface of said cylindrical sleeve; and a water-soluble disinfectant composition disposed in said perforated compartment, whereby pressurized effluent will cause the displacement of the valve means to said open position permitting discharge of the effluent through the clean out and simultaneous release of said water-soluble disinfectant composition from said perforated compartment into the effluent.

2. The device of claim 1, wherein said cylindrical sleeve includes at least two longitudinal slots therein having a length and an upper portion terminating in a flange; and said valve means comprises a float member vertically displaceable in said cylindrical sleeve, said float member having an upper portion having a configuration complementary to said flange wherein said upper portion is seated in said flange in said closed position and includes a top surface forming a cover for said clean out in said closed position; said float member further comprising an elongate lower portion descending into said cylindrical sleeve, said lower portion including at least two arms extending laterally therefrom corresponding to said at least two slots wherein said arms are slidably positioned in said slots wherein said float member is fixedly attached to said cylindrical sleeve and upwardly vertically displaceable along the length of said longitudinal slots to said open position.

3. The device of claim 1, wherein said at least one perforated compartment is formed as an annular container concentrically positioned in said cylindrical sleeve.

4. The device of claim 1, further comprising a water-soluble dye composition disposed in said compartment.

5. The device of claim 2, wherein said lower portion of said float member has a frusto-conical configuration.

6. The device of claim 1, further comprising:

a sensing means for detecting when said valve means is in an open position;

an alarm means coupled to said sensing means, wherein said alarm means is activated when said valve is in said open position; and a timing means coupled to said alarm means whereby said alarm means is activated continuously for a predetermined period.

7. The device of claim 6, wherein said alarm means is a light emitting diode (LED).

8. The device of claim 2, wherein said upper portion and said lower portion of said float member are detachable from one another.

9. The device of claim 8, wherein said upper portion and said lower portion respectively include mated threads.

10. The device of claim 5, further comprising:

a first magnetic strip adjoined to said cylindrical sleeve;

a second magnetic member strip adjoined to said float member wherein said first magnetic strip and said second magnetic strip are in contact with one another when said float member is in said closed position;

an electric circuit disposed in said float member in electrical communication with a power source;

an alarm means in electrical communication with said circuit; and a switch means in communication with said second magnetic strip and said electric circuit, said switch means operable to energize said electric circuit when contact between said first and second magnetic strips is terminated, wherein said alarm means is activated when said contact is broken.

11. The device of claim 10, further comprising a timing means coupled to said alarm means, wherein said alarm means is activated continuously for a predetermined period.

12. The device of claim 6, wherein said alarm means is a light emitting diode (LED) disposed on said top surface of said float member.

13. The device of claim 6, wherein said alarm means is an audible alarm.

14. The device of claim 6, wherein said alarm means is an RF transmission.

15. The device of claim 1, wherein said cylindrical sleeve is constructed from polyvinyl chloride (PVC).

16. The device of claim 1, wherein said float member is constructed from polyvinyl chloride (PVC).

17. The device of claim 1, wherein said at least one perforated compartment comprises a plurality of walls defining an interior space wherein one of said walls includes a hingedly moveable door member having a latch means attached thereto whereby said interior space can be accessed to replenish said water-soluble disinfectant composition.

* * * * *